US008394207B2

(12) United States Patent
Spangenberg

(10) Patent No.: US 8,394,207 B2
(45) Date of Patent: Mar. 12, 2013

(54) CYLINDER JACKET AND METHOD FOR PRODUCING THE SAME

(75) Inventor: Stefan Spangenberg, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 306 days.

(21) Appl. No.: 12/733,392

(22) PCT Filed: Aug. 23, 2008

(86) PCT No.: PCT/DE2008/001392

§ 371 (c)(1),
(2), (4) Date: Jun. 14, 2010

(87) PCT Pub. No.: WO2009/026897

PCT Pub. Date: Mar. 5, 2009

(65) Prior Publication Data

US 2010/0263765 A1 Oct. 21, 2010

(30) Foreign Application Priority Data

Aug. 31, 2007 (DE) ..... 10 2007 041 519

(51) Int. Cl.
*C23C 8/04* (2006.01)
*C23C 8/22* (2006.01)
*C22C 38/00* (2006.01)

(52) U.S. Cl. ..... 148/211; 148/210; 148/319

(58) Field of Classification Search ..... 148/211, 148/210, 319

See application file for complete search history.

(56) References Cited

U.S. PATENT DOCUMENTS

| | | | | |
|---|---|---|---|---|
| 2,696,434 | A * | 12/1954 | Bartlett | 419/2 |
| 4,202,710 | A | 5/1980 | Naito et al. | |
| 6,048,625 | A | 4/2000 | Miura et al. | |
| 6,090,225 | A | 7/2000 | Pichard | |

FOREIGN PATENT DOCUMENTS

| | | |
|---|---|---|
| DE | 696 00 908 | 5/1999 |
| EP | 0 525 540 | 2/1993 |
| EP | 0 872 567 | 10/1998 |
| EP | 0 890 653 | 1/1999 |
| GB | 2 146 409 | 4/1985 |
| JP | 05-059427 | 3/1993 |
| JP | 2002-088449 | 3/2002 |
| SU | 812 835 | 3/1981 |

OTHER PUBLICATIONS

International Search Report.

German Search Report with English translation of relevant parts.

Przylecka, Malgorzata et al., "Influence of carbon content on structure and properties of carburized steel using different quenchants—part 1," Quenching and the Control of Distortion, Proceedings of the International Conference on Quenching and the Control of Distortion, 4th, Beijing, China, May 2003, ASM International, Materials Park, Ohio, pp. 1-7. XP-008101314 (ISR).

* cited by examiner

*Primary Examiner* — Jessee R. Roe

(74) *Attorney, Agent, or Firm* — Collard & Roe, P.C.

(57) ABSTRACT

The invention relates to a method for producing a cylinder jacket, comprising the following steps: producing a cylindrical starting product from a steel material having a carbon content of not more than 0.8% by weight and a ferritic or ferritic/pearlitic structure; enriching, by carburization, the surface layer of the inner peripheral surface of the cylindrical starting product with carbon in the form of carbides that are deposited on the grain boundaries; slowly cooling the cylindrical starting product in such a manner that a pearlitic structure having a carbide network is formed in the surface layer; finishing the cylindrical starting product to give a cylinder jacket. The invention also relates to a cylinder jacket produced by said method.

10 Claims, 1 Drawing Sheet

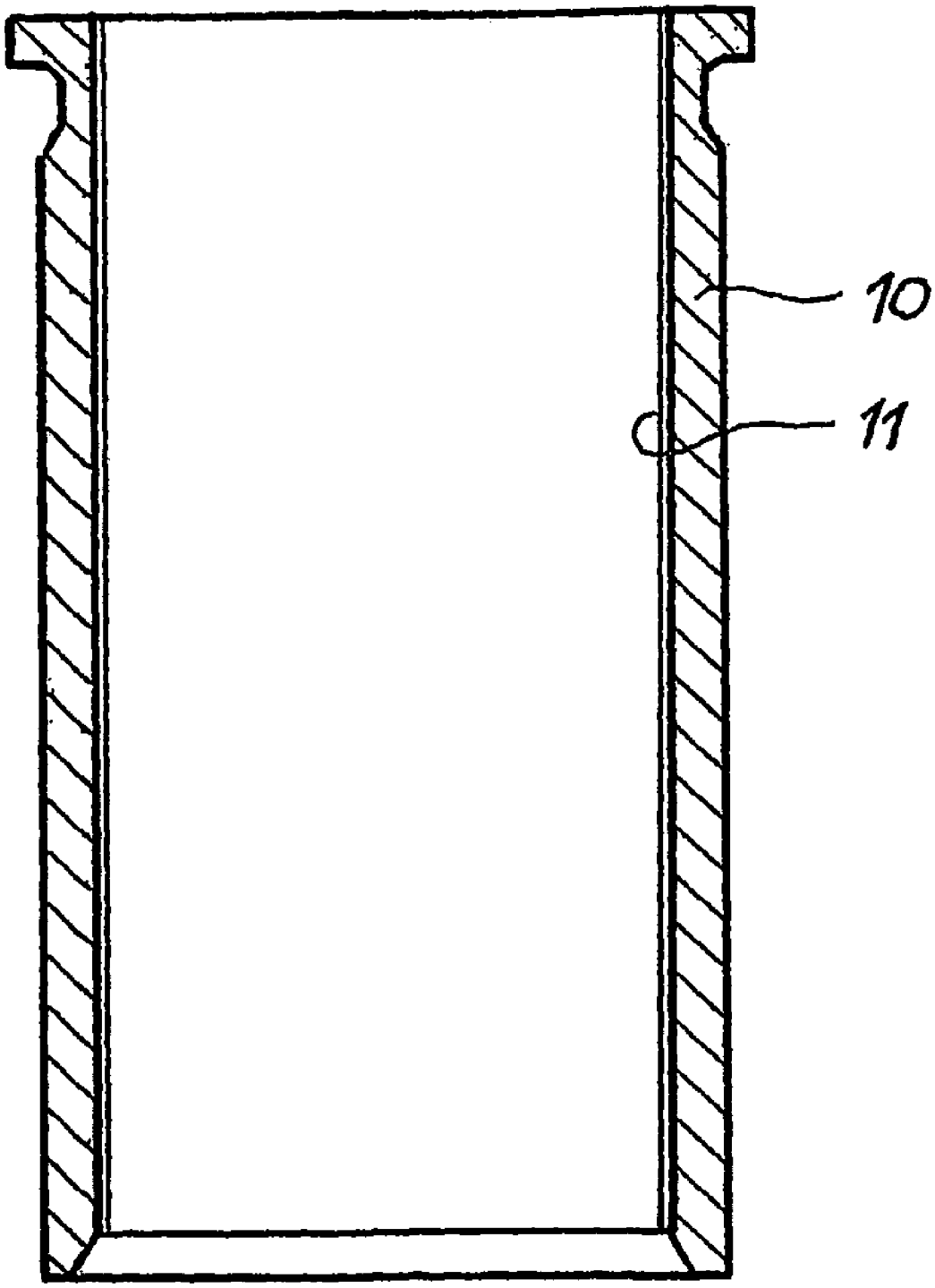
10
11

CYLINDER JACKET AND METHOD FOR PRODUCING THE SAME

CROSS REFERENCE TO RELATED APPLICATIONS

This application is the National Stage of PCT/DE2008/001392 filed on Aug. 23, 2008, which claims priority under 35 U.S.C. §119 of German Application No. 10 2007 041 519.4 filed on Aug. 31, 2007. The international application under PCT article 21(2) was not published in English.

BACKGROUND OF THE INVENTION

The present invention relates to a method for the production of a cylinder sleeve, as well as to such a cylinder sleeve.

Cylinder sleeves for internal combustion engines are nowadays generally produced from cast iron with lamellar graphite as the material. The cast iron with lamellar graphite used for this purpose consists of the structural components pearlite and graphite, and is frequently alloyed with 0.1 to 1.2% phosphorus, in order to increase the wear resistance of this material. Wear on a cylinder sleeve is brought about, in engine operation, by the piston rings, on the one hand, and by the piston skirt, on the other hand, both of which interact with the inner mantle surface (or working surface) of the cylinder sleeve. By means of alloying in phosphorus, a phase that consists of iron, carbon, and phosphorus is formed in the material, which is referred to as steadite. This phase is distributed in net-like form around the eutectic cells of the cast iron, in the material structure, and is characterized by great hardness. As an alternative, elements that promote carbide formation to a great degree, for example niobium or boron, can be alloyed into the cast iron. This results in carbides that form a net-like structure similar to steadite. Furthermore, the pearlite contained in the cast iron contributes to great resistance to wear and seizing, since carbides in a lamellar structure are contained in pearlite.

For modern engines, particularly modern diesel engines, cylinder sleeves made from cast iron with lamellar graphite as a material are only suitable with restrictions. In particular, the ignition pressure required in modern diesel engines requires a switch to high-strength materials. These high-strength materials also include steel. In this connection, it is desirable to implement the structures of pearlite with carbides in a net-like structure known from the cast iron materials in the steels used for cylinder sleeves, in order to achieve good resistance to wear and seizing. This is not possible, however, since steels having a carbon content of more than 0.8 mass-% are required for this. Such steels are extremely difficult to form, because of their great hardness and strength, can only be welded with additional treatment, and can be worked using cutting methods only at great tool wear. The use of such steels is therefore excluded, because an unjustifiable amount of effort is connected with it.

SUMMARY OF THE INVENTION

The present invention is therefore based on the task of making available a method for the production of cylinder sleeves as well as cylinder sleeves produced in this manner, which meet the requirements of modern engines and are particularly characterized by great resistance to wear and seizing.

The solution consists in a method having the characteristics of claim 1, as well as of cylinder sleeves produced by means of this method. According to the invention, it is provided that first, a cylindrical pre-product is produced from a steel material having a carbon content of at most 0.8 mass-% and a ferrite or ferrite/pearlite structure, then the edge layer of the inner mantle surface of the cylindrical pre-product is enriched with carbon in the form of carbides that are deposited on the grain boundaries, by means of carburization, subsequently the cylindrical pre-product is slowly cooled off, in such a manner that a pearlite structure with a network of carbides is formed in the edge layer, and finally, the cylindrical pre-product is finished to produce a cylinder sleeve.

The cylinder sleeves according to the invention are particularly characterized by a steel material having a carbon content of at most 0.8 mass-%, and a ferrite or ferrite/pearlite structure, whereby at least the inner mantle surface of the cylinder sleeve has a pearlite structure with a network of carbides.

Using the method according to the invention, cylinder sleeves made from steels having a carbon content of at most 0.8 mass-% can be produced in simple, effective, and cost-advantageous manner. Nevertheless, the cylinder sleeves according to the invention have a pearlite structure with a network of carbides along their inner mantle surface, i.e. in the region of their working surface. This structure imparts excellent resistance to wear and seizing to the inner mantle surface. It is therefore possible to produce a cylinder sleeve from a steel material, with little effort, and to work it in cutting manner, with little tool wear, which sleeve nevertheless has a structure in the region of its working surfaces that is similar to that of cast iron with lamellar graphite, and up to now could only be achieved with extremely hard and strong steels, i.e. which could not be worked in economically efficient manner. Furthermore, during carburization, the long-term strength of the material as a whole is improved, and this has a positive effect on the useful lifetime of the cylinder sleeve according to the invention.

Advantageous further developments are evident from the dependent claims.

Preferably, a steel material having a carbon content of 0.1 mass-% to 0.6 mass-% is used. Such a steel material can be shaped or worked in cutting manner with particular ease, because of its relatively low carbon content. A steel material having a carbon content of at most 0.25 mass-% has proven to be particularly practical.

Since there is the risk when machining such a steel material having a carbon content of at most 0.8 mass-%, that flowing chips might occur, it can be advisable, in some circumstances, to add additives that promote chip breakage to the steel material. Such additives, such as manganese and/or sulfur and/or lead, for example, are known to a person skilled in the art.

For particularly simple production of the cylindrical pre-product, a sheet that has been produced from the steel material can be bent and welded at the seam location to form a pipe, for example by means of laser welding, electron beam welding, inductive welding or fusion welding.

During production of the cylindrical pre-product, particularly during the shaping process, at least one flange and/or at least one outer contour can be formed, for example. In this way, the effort of the subsequent working of the cylindrical pre-product, particularly by machining, to form the finished cylindrical sleeve, is reduced.

Carburization fundamentally takes place by means of methods known to a person skilled in the art, using a solid, liquid, or gaseous carburization agent. The carburization agent can contain nitrogen, if necessary, so that a process similar to carbonitration results.

BRIEF DESCRIPTION OF THE DRAWING

An exemplary embodiment of the present invention will be explained in greater detail in the following, using a drawing.

The drawing shows a cross section of a cylinder sleeve according to the invention.

DETAILED DESCRIPTION OF THE EMBODIMENTS

The single FIGURE schematically shows, not to scale, an exemplary embodiment of a cylinder sleeve 10 according to the invention, made from a steel material having a carbon content of at most 0.8 mass-%, which was produced by means of the method according to the invention. Along the inner mantle surface, i.e. along the working surface, an edge layer 11 having pearlite structure with a network of carbides is produced, using the method according to the invention.

The invention claimed is:

1. Method for the production of a cylinder sleeve, comprising the following method steps:

production of a cylindrical pre-product composed of a steel material, having a carbon content of at most 0.8 mass-% and a ferrite or ferrite/pearlite structure;

enrichment of the edge layer, at least of the inner mantle surface of the cylindrical pre-product, with carbon, in the form of carbides that deposit on the grain boundaries, by means of carburization;

slow cooling of the cylindrical pre-product in such a manner that a pearlite structure with a network of carbides is formed in the edge layer;

finish work of the cylindrical pre-product to produce a cylinder sleeve.

2. Method according to claim 1, wherein a steel material having a carbon content of 0.1 mass-% to 0.6 mass-% is used.

3. Method according to claim 1, wherein a steel material having a carbon content of at most 0.25 mass-% is used.

4. Method according to claim 1, wherein a steel material is used that contains additives that promote chip breakage.

5. Method according to claim 4, wherein a steel material is used that contains at least one of manganese, sulfur and lead as additives.

6. Method according to claim 1, wherein a sheet produced from a steel material is bent to produce the cylindrical pre-product, and welded at the seam location to produce a pipe.

7. Method according to claim 6, wherein the seam location is welded by means of laser welding, electron beam welding, inductive welding, or fusion welding.

8. Method according to claim 1, wherein at least one flange or at least one outside contour is pre-formed during production of the cylindrical pre-product.

9. Method according to claim 1, wherein carburization takes place by means of a solid, liquid, or gaseous carburization agent.

10. Method according to claim 1, wherein the carburization material contains nitrogen.

* * * * *

UNITED STATES PATENT AND TRADEMARK OFFICE

CERTIFICATE OF CORRECTION

PATENT NO. : 8,394,207 B2
APPLICATION NO. : 12/733392
DATED : March 12, 2013
INVENTOR(S) : Stefan Spangenberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 411 days.

Signed and Sealed this
First Day of September, 2015

Michelle K. Lee

Michelle K. Lee
*Director of the United States Patent and Trademark Office*